US006575876B1

(12) United States Patent
Phelps-McMillon

(10) Patent No.: US 6,575,876 B1
(45) Date of Patent: Jun. 10, 2003

(54) SUPPORT BELT DEVICE

(76) Inventor: Patricia Phelps-McMillon, 1437 Denver Way, Merced, CA (US) 95348

( * ) Notice: Subject to any disclaimer, the term of this patent is extended or adjusted under 35 U.S.C. 154(b) by 273 days.

(21) Appl. No.: 09/714,917

(22) Filed: Nov. 17, 2000

(51) Int. Cl.[7] ..... A63B 71/00

(52) U.S. Cl. ..... 482/51; 482/54; 482/69; 482/74

(58) Field of Search ..... 482/51, 54, 69, 482/74, 128, 908; 52/57, 74, 124, 122, 148

(56) References Cited

U.S. PATENT DOCUMENTS 1,766,089 A 6/1930 Wood
4,964,401 A * 10/1990 Taigen ..... 128/876
5,158,510 A * 10/1992 Lemire ..... 44/314
5,518,510 A * 5/1996 Daly et al. ..... 44/314
5,626,540 A 5/1997 Hall
5,704,880 A 1/1998 Amatulle
D390,896 S 2/1998 Stalnaker
5,919,119 A 7/1999 Bohmer et al.
6,059,696 A * 5/2000 Bohmer et al. ..... 482/54
6,264,584 B1 * 7/2001 Bass ..... 482/54

* cited by examiner

*Primary Examiner*—Nicholas D. Lucchesi
*Assistant Examiner*—Tam Nguyen

(57) ABSTRACT

A support belt device for allowing a user to walk or run on a treadmill without holding on to the treadmill handle. The support belt device includes a panel. The panel includes a first end, a second end, a front side, a back side and a peripheral edge integrally coupled to and extending between the front side and the back side. A strap that includes a first end and a second end is securably attached to the backside of the panel. A pair of coupling members is designed for coupling the first and second ends of the strap to the handrail of the treadmill.

8 Claims, 2 Drawing Sheets

SUPPORT BELT DEVICE

BACKGROUND OF THE INVENTION

1. Field of the Invention

The present invention relates to exercise belts and more particularly pertains to a new support belt device for allowing a user to walk or run on a treadmill without holding on to the treadmill handle.

2. Description of the Prior Art

The use of exercise belts is known in the prior art. More specifically, exercise belts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,158,510; U.S. Pat. No. 5,919,119; U.S. Pat. No. 5,704,880; U.S. Pat. No. 5,626,540; U.S. Pat. No. 1,766,089; and U.S. Pat. No. Des. 390,896.

While these devices fulfill their respective, particular objectives and requirements, the aforementioned patents do not disclose a new support belt device. The inventive device includes a panel. The panel includes a first end, a second end, a front side, a back side and a peripheral edge integrally coupled to and extending between the front side and the back side. A strap that includes a first end and a second end is securably attached to the back side of the panel. A pair of coupling members is designed for coupling the first and second ends of the strap to the handrail of the treadmill.

In these respects, the support belt device according to the present invention substantially departs from the conventional concepts and designs of the prior art, and in so doing provides an apparatus primarily developed for the purpose of allowing a user to walk or run on a treadmill without holding on to the treadmill handle.

SUMMARY OF THE INVENTION

In view of the foregoing disadvantages inherent in the known types of exercise belts now present in the prior art, the present invention provides a new support belt device construction wherein the same can be utilized for allowing a user to walk or run on a treadmill without holding on to the treadmill handle.

The general purpose of the present invention, which will be described subsequently in greater detail, is to provide a new support belt device apparatus and method which has many of the advantages of the exercise belts mentioned heretofore and many novel features that result in a new support belt device which is not anticipated, rendered obvious, suggested, or even implied by any of the prior art exercise belts, either alone or in any combination thereof.

To attain this, the present invention generally comprises a panel. The panel includes a first end, a second end, a front side, a back side and a peripheral edge integrally coupled to and extending between the front side and the back side. A strap that includes a first end and a second end is securably attached to the back side of the panel. A pair of coupling members is designed for coupling the first and second ends of the strap to the handrail of the treadmill.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support belt device apparatus and method which has many of the advantages of the exercise belts mentioned heretofore and many novel features that result in a new support belt device which is not anticipated, rendered obvious, suggested, or even implied by any of the prior art exercise belts, either alone or in any combination thereof.

It is another object of the present invention to provide a new support belt device which may be easily and efficiently manufactured and marketed.

It is a further object of the present invention to provide a new support belt device which is of a durable and reliable construction.

An even further object of the present invention is to provide a new support belt device which is susceptible of a low cost of manufacture with regard to both materials and labor, and which accordingly is then susceptible of low prices of sale to the consuming public, thereby making such support belt device economically available to the buying public.

Still yet another object of the present invention is to provide a new support belt device which provides in the apparatuses and methods of the prior art some of the advantages thereof, while simultaneously overcoming some of the disadvantages normally associated therewith.

Still another object of the present invention is to provide a new support belt device for allowing a user to walk or run on a treadmill without holding on to the treadmill handle.

Yet another object of the present invention is to provide a new support belt device which includes a panel. The panel includes a first end, a second end, a front side, a back side and a peripheral edge integrally coupled to and extending between the front side and the back side. A strap that includes a first end and a second end is securably attached to the back side of the panel. A pair of coupling members is designed for coupling the first and second ends of the strap to the handrail of the treadmill.

Still yet another object of the present invention is to provide a new support belt device that is padded reducing the potential of injuring a user's body by rubbing against the user's body while the device is being used.

Even still another object of the present invention is to provide a new support belt device that is adjustable to the to the person using the device reducing the need to have multiple devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
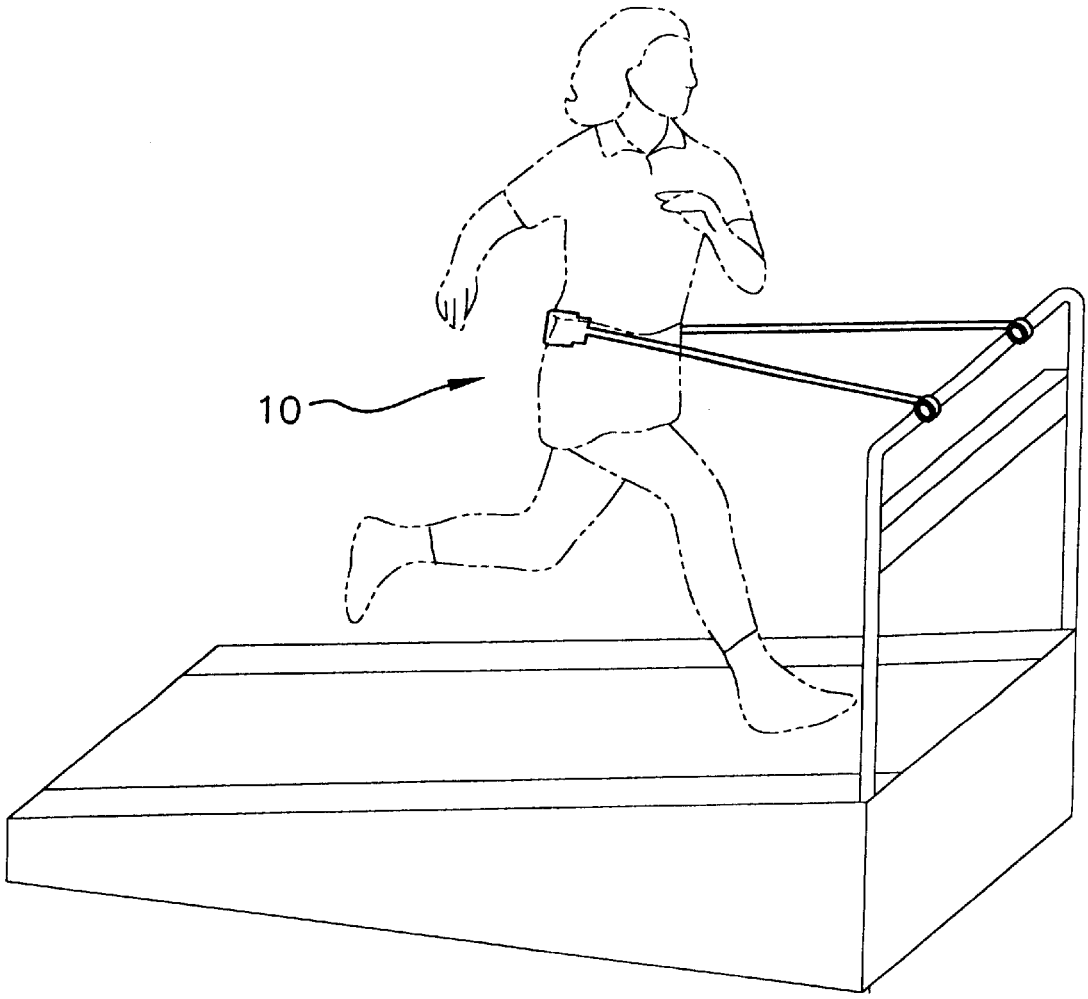
FIG. 1 is a schematic perspective view of a new support belt device according to the present invention.
Figure 2:
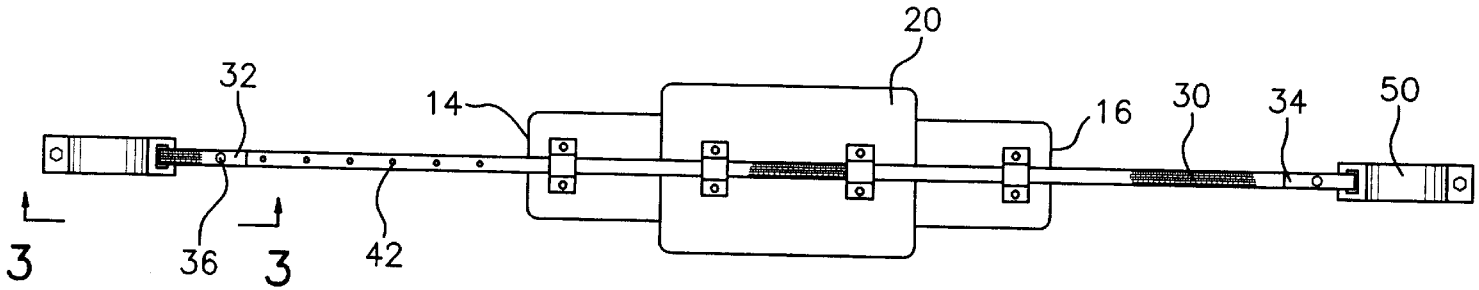
FIG. 2 is a schematic back side view of the present invention.
Figure 3:
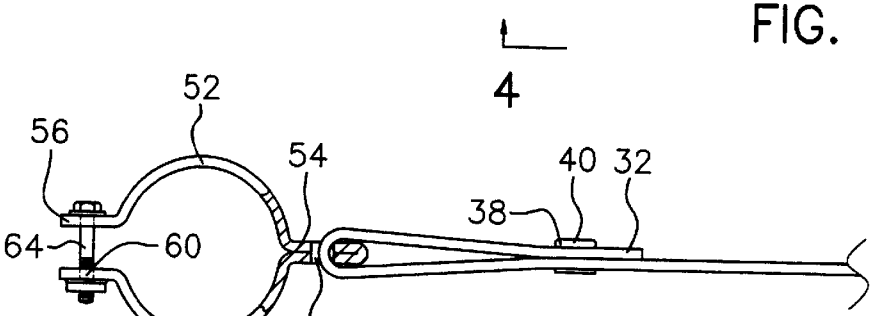
FIG. 3 is a schematic perspective view of the present invention showing a coupling member attached to a strap.
Figure 4:
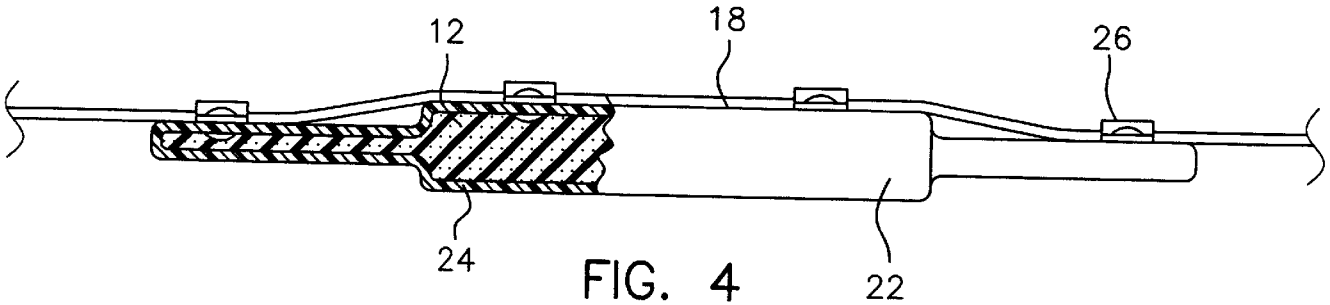
FIG. 4 is a schematic partial cut-away view of the present invention taken along line 4—4.

With reference now to the drawings, and in particular to FIGS. 1 through 4 thereof, a new support belt device embodying the principles and concepts of the present invention and generally designated by the reference numeral 10 will be described.

As best illustrated in FIGS. 1 through 4, the support belt device 10 generally comprises a panel 12. The panel 12 includes a first end 14, a second end 16, a front side 18, a back side 20 and a peripheral edge 22 integrally coupled to the front side 18 and the back side 22 and extending therebetween. The front and back sides 18 and 22 taper toward each of the ends 14 and 16 allowing the ends of the panel 12 to be thinner and more flexible. The panel 12 comprises a relatively soft and resiliently elastomeric material such as foam. Other materials may also be used such as a cotton padding. The panel 12 provides the user with a comfortable back support while running on the treadmill. The first end 14 and second end 16 wrap around the user's waist ensuring a more comfortable fit.

A covering member 24 generally covers and is securably attached to the panel 12. The covering member 24 may comprise a cloth material such as cotton. However, it may also comprise a synthetic material such as vinyl. The purpose of the covering member is to provide a barrier between the user and the panel 12. The covering member 24 may comprise a plurality of designs making the support belt device 10 fashionable for users at a gym.

A plurality of arced members 26 is securably attached to and extending away from the covering member 24. Each of the arced members 26 is positioned generally on the back side 20 of the panel 12. Each of the arced members 26 is spaced between the first and second ends 14 and 16 of the panel. Each of the arced members 26 may be securably attached to the covering by a small rivet or an adhesive. Each of the arced members 26 comprises a substantially rigid material such as aluminum, steel or a rigid plastic.

A strap 30 that includes a first end 32 and a second end 34 is movably extended in the arced members 26. The strap 30 comprises a resiliently flexible material such as a rubber. For added support the strap 30 may comprise a non-elastomeric material such as rope or nylon.

A fastening means 36 for shortening or lengthening the strap 30 is included in an embodiment. The fastening means 36 comprises a snap fastener 38. The snap fastener 38 includes a male snap member 40 that is securably attached to the strap 30 and positioned generally adjacent to the first end 32 of the strap 30. The male snap member 40 comprises a panel having a generally concave shape with an annular member being securably coupled in the concave panel.

A plurality of female snap members 42 is securably attached to the strap 30 and positioned generally between the male snap member 40 and the first end 14 of the panel 12. Each of the female snap members 42 is positioned apart from each other along the strap 30. Each of the female snap members 42 comprises a generally annular wall having a shape and sized adapted for removably positioning in the male snap member 40 and for selectively engaging the annular member in the male snap member. By fastening the male snap member 40 to one of the female snap members 42 the strap 30 may be lengthened or shortening depending upon the need of the user.

There is a pair of coupling members 50 designed for coupling the first and second ends 32 and 34 of the strap 30 to the handrail of the treadmill. Each of the coupling members 50 comprises a pair of arcuate members 52. Each of the arcuate members 52 includes a first tab 54 and a second tab 56 integrally coupled thereto and extending outwardly away therefrom. The first tab 54 of each of the arcuate members 52 is integrally coupled together. The first tab 54 of each of the arcuate members 52 includes a hole 58 extending therethrough. Each of the ends 32 and 34 of the strap 30 is removably extended in the hole 58 of one of the coupling members 50. The second tab 56 of each of the arcuate members 50 includes an aperture 60 extending therethrough. The apertures 60 of each of the second tabs 56 are aligned.

There is a pair of securing means 64 for removably securing each of the coupling members 50 to the handrail of the treadmill. Each of the securing means 64 is removably positionable and extending through the apertures 60 in the second tabs 56. Each of the securing means 64 comprises a nut and bolt.

In use, the user steps onto the tread and positions the support belt device 10 around their waist. The strap 30 is then adjusted for the particular user using the device by fastening the male snap member 40 to the most female snap member 42 that is comfortable for the user. The user then begins the treadmill and shifts their weight to the support belt device 10. The support belt device 10 allows the user to walk or run more naturally on the treadmill by reducing the need to hold on to the treadmill handrail. The panel 12, in conjunction with the strap 30, provides the balance necessary to allow the user to swing their arms while walking or running.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support belt device, said support belt device being adapted for use with a treadmill having a handrail, said device comprising:

a panel, said panel having a first end, a second end, a front side, a back side and a peripheral edge integrally coupled to and extending between said front side and said back side;

a strap, said strap having a first end and a second end, said strap being securably attached to said back side of said panel;

a pair of coupling members being adapted for coupling said first and second ends of said strap to the handrail of the treadmill;

a covering member, said covering member generally covering and being securably attached to said panel; and a plurality of arced members, each of said arced members being securably attached to and extending away from said covering member, said strap being movably extended in each of said arced members, wherein said first and second ends of said strap extend outwardly away from said first and second ends of said panel respectively such that said cover member and said panel member are slidable along said strap member to move with a user when the user is using the treadmill.

2. The support belt device of claim 1, wherein said panel further comprises:

said front and back surfaces of said panel tapering toward each of said ends.

3. The support belt device of claim 1, wherein each of said arced members further comprises:

each of said arced members being positioned generally on said back side of said panel, each of said arced members being spaced between said first and second ends of said panel.

4. The support belt device of claim 1, further comprising:

a fastening means for shortening or lengthening said strap by adjusting said first end of said strap.

5. The support belt device of claim 4, wherein said fastening means further comprises:

said fastening means comprising a snap fastener, said snap fastener having a male snap member being securably attached to said strap and positioned generally adjacent to said first end of said strap, a plurality of female snap members being securably attached to said strap and positioned generally adjacent to said male snap member.

6. The support belt device of claim 1, wherein each of said coupling members further comprises:

a pair of arcuate members, each of said arcuate members having a first tab and a second tab integrally coupled thereto and extending outwardly away therefrom, said first tab of each of said arcuate members being integrally coupled together, said first tab of each of said arcuate members having a hole extending therethrough, each of said ends of said strap being removably extended in said hole of each of said coupling members, said second tab of each of said arcuate members having an aperture extending therethrough, said aperture of each of said second tabs being aligned.

7. The support belt device of claim 6, further comprising;

a pair of securing means for removably securing each of said coupling members a handrail of a treadmill, each of said securing means being removably positionable and extending through said apertures in said second tabs.

8. A support belt device, said support belt device being adapted for use with a treadmill having a handrail, said device comprising:

a panel, said panel having a first end a second end, a front side, a back side and a peripheral edge integrally coupled to said front side and said back side and extending therebetween, said front and back surfaces tapering toward each of said ends, said panel comprising a relatively soft and resiliently elastomeric material;

a covering member, said covering member generally covering and being securably attached to said panel, said covering member comprising a cloth material;

a plurality of arced members, each of said arced members being securably attached to and extending away from said covering member, each of said arced members being positioned generally on said back side of said panel, each of said arced members being spaced between said first and second ends of said panel, each of said arced members comprising a substantially rigid material;

a strap, said strap having a first end and a second end, said strap being movably extended in said arced members such that said cover member and said panel member are slidable along said strap member to move with a user when the user is using the treadmill, said strap comprising a resiliently flexible material;

a fastening means for shortening or lengthening said strap, said fastening means comprising a snap fastener, said snap fastener having a male snap member being securably attached to said strap and positioned generally adjacent to said first end of said strap, a plurality of female snap members being securably attached to said strap and positioned generally between said male snap member and said first end of said panel, each of said female snap members being positioned apart from each other;

a pair of coupling members being adapted for coupling said first and second ends of said strap to the handrail of the treadmill, each of said coupling members comprising;

a pair of arcuate members, each of said arcuate members having a first tab and a second tab integrally coupled thereto and extending outwardly away therefrom, said first tab of each of said arcuate members being integrally coupled together, said first tab of each of said arcuate members having a hole extending therethrough, each of said ends of said strap being removably extended in said hole of each of said coupling members, said second tab of each of said arcuate members having an aperture extending therethrough, said aperture of each of said second tabs being aligned; and a pair of securing means for removably securing each of said coupling members to the handrail of the treadmill, each of said securing means being removably positionable and extending through said apertures in said second tabs, each of said securing means comprising a nut and bolt.

* * * * *